US008951405B2

(12) United States Patent
Moran et al.

(10) Patent No.: US 8,951,405 B2
(45) Date of Patent: Feb. 10, 2015

(54) UPGRADING OF ASPHALTENE-DEPLETED CRUDES

(75) Inventors: Lyle Edwin Moran, Sarnia (CA); Mary Josephine Gale, Lambton Shore (CA); John H. Brownie, Brights Grove (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 335 days.

(21) Appl. No.: 13/486,146

(22) Filed: Jun. 1, 2012

(65) Prior Publication Data

US 2013/0319909 A1 Dec. 5, 2013

(51) Int. Cl.
*C10C 1/20* (2006.01)

(52) U.S. Cl.
USPC ..... 208/44

(58) Field of Classification Search
CPC ..... C10C 3/04; C10C 3/005; C10C 3/00
USPC ..... 208/6
See application file for complete search history.

(56) References Cited

U.S. PATENT DOCUMENTS

| | | | | |
|---|---|---|---|---|
| 2,277,842 | A * | 3/1942 | Bray | 208/4 |
| 2010/0147190 | A1* | 6/2010 | Naidoo et al. | 106/229 |
| 2012/0132565 | A1 | 5/2012 | Aldous | |
| 2013/0062055 | A1 | 3/2013 | Tolman et al. | |

FOREIGN PATENT DOCUMENTS

CA 2750402 A1 2/2012

OTHER PUBLICATIONS

Moschopedis, S.E. and Speight, J.G., "An Investigation of Asphalt Preparation from Athabasca Bitumen", Asphalt Paving Technology, vol. 45, Jan. 1, 1976, pp. 78-89.

* cited by examiner

*Primary Examiner* — Randy Boyer
*Assistant Examiner* — Juan Valencia
(74) *Attorney, Agent, or Firm* — Robert A. Migliorini

(57) ABSTRACT

Methods are provided for upgrading asphaltene-depleted crude fractions. The asphaltene-depleted crude fractions are upgraded by oxidizing the crude fractions by air blowing. Upgrading an asphaltene-depleted crude fraction can allow more valuable grades of asphalt to be formed from the crude fraction. Alternatively, upgrading an asphaltene-depleted crude fraction can allow for incorporation of a greater percentage of such a crude fraction in a blend of crudes that are used for making a desired grade of asphalt.

18 Claims, 6 Drawing Sheets

UPGRADING OF ASPHALTENE-DEPLETED CRUDES

FIELD OF THE INVENTION

This disclosure provides high performance asphalt composition, and a method producing such a high performance asphalt composition using an alkane deasphalting residue.

BACKGROUND

Asphalt is one of the world's oldest engineering materials, having been used since the beginning of civilization. Asphalt is a strong, versatile and chemical-resistant binding material that adapts itself to a variety of uses. For example, asphalt is used to bind crushed stone and gravel into firm tough surfaces for roads, streets, and airport runways. Asphalt, also known as pitch, can be obtained from either natural deposits, or as a by-product of the petroleum industry. Natural asphalts were extensively used until the early 1900s. The discovery of refining asphalt from crude petroleum and the increasing popularity of the automobile served to greatly expand the asphalt industry. Modern petroleum asphalt has the same durable qualities as naturally occurring asphalt, with the added advantage of being refined to a uniform condition substantially free of organic and mineral impurities.

Most of the petroleum asphalt produced today is used for road surfacing. Asphalt is also used for expansion joints and patches on concrete roads, as well as for airport runways, tennis courts, playgrounds, and floors in buildings. Another major use of asphalt is in asphalt shingles and roll-roofing which is typically comprised of felt saturated with asphalt. The asphalt helps to preserve and waterproof the roofing material. Other applications for asphalt include waterproofing tunnels, bridges, dams and reservoirs, rust-proofing and sound-proofing metal pipes and automotive under-bodies; and sound-proofing walls and ceilings.

The raw material used in modern asphalt manufacturing is petroleum, which is naturally-occurring liquid bitumen. Asphalt is a natural constituent of petroleum, and there are crude oils that are almost entirely asphalt. The crude petroleum is separated into its various fractions through a distillation process. After separation, these fractions are further refined into other products such as asphalt, paraffin, gasoline, naphtha, lubricating oil, kerosene and diesel oil. Since asphalt is the base or heavy constituent of crude petroleum, it does not evaporate or boil off during the distillation process. Asphalt is essentially the heavy residue of the oil refining process.

SUMMARY

In an embodiment, a method is provided for upgrading an asphalt feed. The method includes receiving an asphalt feed comprising an asphaltene-depleted crude fraction, the asphaltene-depleted crude fraction including at least 20 wt % less asphaltenes than the corresponding raw crude; and oxidizing the asphalt feed by air blowing under effective conditions to achieve an increase of a maximum PG temperature in the corresponding asphalt of at least 15° C., the minimum PG temperature increasing by 6° C. or less.

In another embodiment, a method is provided for upgrading an asphalt feed. The method includes receiving an asphalt feed comprising an asphaltene-depleted crude fraction, the asphaltene-depleted crude fraction including at least 20 wt % less asphaltenes than the corresponding raw crude; and oxidizing the asphalt feed by air blowing under effective conditions to achieve an increase of a maximum PG temperature in the corresponding asphalt of at least 15° C., the ratio of the increase of the maximum PG temperature to an increase in the corresponding minimum PG temperature being at least 5 to 2.

In still another embodiment, a method is provided for upgrading an asphalt feed. The method includes receiving an asphalt feed comprising at least an asphaltene-depleted crude fraction, the asphaltene-depleted crude fraction including 20 wt % less asphaltenes than the corresponding raw crude; oxidizing the asphalt feed by air blowing under effective conditions to achieve an increase of a maximum PG temperature of 10° C., a corresponding minimum PG temperature increasing by a first amount; and oxidizing the asphalt feed by air blowing under effective conditions to achieve an additional increase of the maximum PG temperature in the corresponding asphalt of at least 5° C. a ratio of the additional increase of the maximum PG temperature to an additional increase of the corresponding minimum PG temperature being at least 5 to 3.

DETAILED DESCRIPTION

Figure 1:
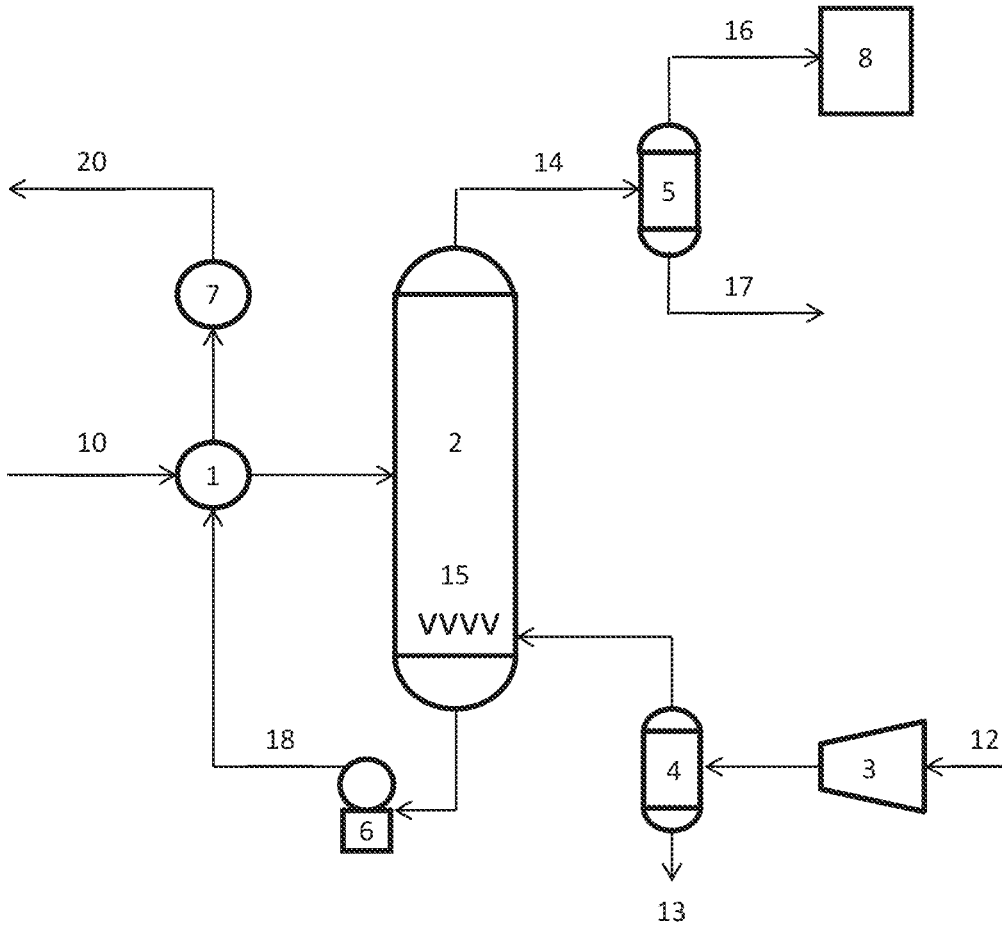
FIG. 1 hereof is a process flow scheme of an asphalt oxidation process.

All numerical values within the detailed description and the claims herein are modified by "about" or "approximately" the indicated value, and take into account experimental error and variations that would be expected by a person having ordinary skill in the art.

Overview

In various aspects, methods are provided for upgrading asphaltene-depleted crude fractions. The asphaltene-depleted crude fractions are upgraded by oxidizing the crude fractions by air blowing. Upgrading an asphaltene-depleted crude fraction can allow more valuable grades of asphalt to be formed from the crude fraction. Alternatively, upgrading an asphaltene-depleted crude fraction can allow for incorporation of a greater percentage of such a crude fraction in a blend of crudes that are used for making a desired grade of asphalt.

It has been discovered that asphaltene-depleted crude oil or bitumen can be improved to a greater degree by air blowing than a conventional crude fraction. Most crudes or crude fractions exhibit similar behavior when oxidized by air blowing. After an initial modest improvement in high temperature properties with little detriment to low temperature properties, further air blowing of a conventional crude results in a predictable trade-off of improved high temperature properties and decreased low temperature properties. Without being bound by any particular theory, it is believed that this trade-off of gaining improved high temperature properties at the expense of less favorable low temperature properties is due to a phase instability in the oxidized crude oil or bitumen. Therefore, air blowing is of limited benefit for production of asphalt from conventional crudes under the SUPERPAVE™ standard used in North America. By contrast, oxidation of asphaltene-depleted crudes by air blowing can be used to improve the high temperature properties to a much greater degree with only a modest impact on the corresponding low temperature properties. As a result, air blowing can be used effectively to upgrade asphaltene-depleted crudes (including mixtures containing asphaltene-depleted crudes) that would otherwise be considered as not suitable for making typical North American asphalt grades.

Feedstocks

An increasing proportion of crude oil production corresponds to heavier crude oils as well as non-traditional crudes, such as crude oils derived from oil sands. Initial extraction of heavier crude oils and non-traditional crudes can present some additional challenges. For example, during mining or extraction of oil sands, a large percentage of non-petroleum material (such as sand) is typically included in the raw product. This non-petroleum material is typically separated from the crude oil at the extraction site. One option for removing the non-petroleum material is to first mix the raw product with water. Air is typically bubbled through the water to assist in separating the bitumen from the non-petroleum material. This will remove a large proportion of the solid, non-petroleum material in the raw product. However, smaller particles of non-petroleum particulate solids will typically remain with the oil phase at the top of the mixture. This top oil phase is sometimes referred to as a froth.

Separation of the smaller non-petroleum particulate solids can be achieved by adding an extraction solvent to the froth of the aqueous mixture. This is referred to as a "paraffinic froth treatment" (PFT). Examples of typical solvents include isopentane, pentane, and other light paraffins (such as $C_5$-$C_8$ paraffins) that are liquids at room temperature. Other solvents such as $C_3$-$C_{10}$ alkanes might also be suitable for use as an extraction solvent for forming an asphaltene-depleted crude, depending on the conditions during the paraffinic froth treatment. Adding the extraction solvent results in a two phase mixture, with the crude and the extraction solvent forming one of the phases. The smaller particulate solids of non-petroleum material are "rejected" from the oil phase and join the aqueous phase. The crude oil and solvent phase can then be separated from the aqueous phase, followed by recovery of the extraction solvent for recycling. This results in a heavy crude oil that is ready either for further processing or for blending with a lighter fraction prior to transport via pipeline. For convenience, a heavy crude oil formed by using a paraffinic froth treatment to separate out particulate non-petroleum material will be referred to herein as a PFT crude oil.

While the above technique is beneficial for removing smaller non-petroleum particulate solids from a crude oil, the paraffinic froth treatment also results in depletion of asphaltenes in the resulting PFT crude oil. Asphaltenes typically refer to compounds within a crude fraction that are insoluble in a paraffin solvent such as n-heptane. When a paraffinic extraction solvent is added to the mixture of raw product and water, between 30 and 60 percent of the asphaltenes in the crude oil are typically "rejected" and lost to the water phase along with the smaller non-petroleum particulate solids. As a result, the PFT crude oil that is separated out from the non-petroleum material corresponds to an asphaltene-depleted crude oil. In other words, prior to the paraffinic froth treatment, the crude oil present in the raw product and water mixture contained an initial level of asphaltenes. By using the paraffinic froth treatment to knock out small particulate solids, the asphaltene content of the crude can be reduced or depleted by at least 30 wt %, such as at least 40 wt %, or at least 45 wt %. In other words, the asphaltene-depleted crude will have 30 wt % less asphaltenes than the corresponding raw crude, such as at least 40 wt %, or at least 45 wt %. Typically, the paraffinic froth treatment will reduce or deplete the asphaltenes in the crude by 60 wt % or less, such as 55 wt % or less, or 50 wt % or less. The amount of asphaltenes that are removed or depleted from a PFT crude oil can depend on a variety of factors. Possible factors that can influence the amount of asphaltene depletion include the nature of the extraction solvent, the amount of extraction solvent relative to the amount of crude oil, the temperature during the paraffinic froth treatment process, and the nature of the raw crude being exposed to the paraffinic froth treatment.

More generally, an asphaltene-depleted crude oil refers to any crude oil that has been deasphalted (such as by a paraffinic froth treatment) prior to transporting the crude to a refinery or other processing facility, such as prior to transporting the crude by pipeline. An asphaltene-depleted crude can have an asphaltene content that is reduced or depleted relative to the initial asphaltene content of the crude oil by at least 20 wt %, such as at least 25 wt %, or at least 35 wt %, or at least 40 wt %, or at least 45 wt %, or at least 50 wt %. Additionally or alternately, an asphaltene-depleted crude can have an asphaltene content that is reduced or depleted relative to the initial asphaltene content of the crude oil by 85 wt % or less, such as 75 wt % or less, or 65 wt % or less, or 60 wt % or less, or 55 wt % or less. Still another alternative is that an asphaltene-depleted crude oil or bitumen may be substantially depleted of all asphaltenes, such as crude oil or bitumen having an asphaltene content that is reduced or depleted by at least 90 wt % or at least 95 wt %.

After forming an asphaltene-depleted crude oil, the asphaltene-depleted crude will typically be transported to a refinery for further processing. For example, after recovery of the extraction solvent used for formation of a PFT crude oil, the resulting PFT crude oil will typically have a high viscosity that is not suitable for transport in a pipeline. In order to transport the PFT crude, the PFT crude can be mixed with a lighter fraction that is compatible with pipeline and refinery processes, such as a naphtha or kerosene fraction. The PFT crude can then be transported to a refinery. Other methods may be used to prepare other types of asphaltene-depleted crudes for pipeline transport (or other transport).

At a refinery, an asphaltene-depleted crude could be used directly as a crude oil. Alternatively, the asphaltene-depleted crude can be blended with one or more crude oils or crude fractions. Crude oils suitable for blending prior to distillation can include whole crudes, reduced crudes, synthetic crudes, or other convenient crude fractions that contain material suitable for incorporation into an asphalt. This blending can occur at the refinery or prior to reaching the refinery. To form asphalt, the asphaltene-depleted crude or the blend of crudes containing the asphaltene-depleted crude is distilled. Typically the crude(s) will be distilled by atmospheric distillation followed by vacuum distillation. The bottoms from the vacuum distillation represents the fraction for potential use as an asphalt feedstock.

Before or after distillation, other feedstocks can be blended with the vacuum distillation bottoms, such as heavy oils that include at least a portion of asphaltenes. Thus, in addition to other crudes or crude fractions, other suitable feedstocks for blending include straight run vacuum residue, mixtures of vacuum residue with diluents such as vacuum tower wash oil, paraffin distillate, aromatic and naphthenic oils and mixtures thereof, oxidized vacuum residues or oxidized mixtures of vacuum residues and diluent oils and the like.

Any convenient amount of an asphaltene-depleted crude fraction may be blended with other feedstocks for forming a feed mixture to produce an asphalt feedstock. One option is to characterize the amount of asphaltene-depleted crude fraction in a mixture of crude fractions prior to distillation to form an asphalt feed. The amount of asphaltene-depleted crude fraction in the mixture of crude fractions can be at least 10 wt % of the mixture, such as at least 25 wt % of the mixture, or at least 40 wt % of the mixture, or at least 50 wt % of the mixture. Additionally or alternately, the amount of asphaltene-depleted crude fraction in the mixture of crude fractions can be 90 wt % of the mixture or less, such as 75 wt % of the mixture or less, or 50 wt % of the mixture or less.

Alternatively, if an asphalt feed based on an asphaltene-depleted crude is blended with other asphalt feeds after distillation to form the asphalt feed, the amount of asphaltene-depleted crude in the asphalt fraction can be characterized. The amount of asphaltene-depleted crude in an asphalt fraction can be at least 25 wt % of the mixture, such as at least 40 wt % of the mixture and/or 75 wt % or less of the mixture, such as 60 wt % or less of the mixture.

One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil. Similarly, a "T95" boiling is defined as the temperature at which 95 wt % of the feed will boil.

A typical feedstock for forming asphalt can have a normal atmospheric boiling point of at least 350° C., more typically at least 400° C., and will have a penetration range from 20 to 500 dmm at 25° C. (ASTM D-5). Alternatively, a feed may be characterized using a T5 boiling point, such as a feed with a T5 boiling point of at least 350° C., or at least 400° C., or at least 440° C.

Air Blowing

Various types of systems are available for oxidizing a crude by air blowing. FIG. 1 shows an example of a typical asphalt oxidation process. An asphalt feed is passed via line 10 through heat exchanger 1 where it is preheated to a temperature from 125° C. to 300° C., then to oxidizer vessel 2. Air, via line 12, is also introduced to oxidizer vessel 2 by first compressing it by use compressor 3 then passing it through knockout drum 4 to remove any condensed water or other liquids via line 13. The air flows upward through a distributor 15 and countercurrent to down-flowing asphalt. The air is not only the reactant, but also serves to agitate and mix the asphalt, thereby increasing the surface area and rate of reaction. Oxygen is consumed by the asphalt as the air ascends through the down flowing asphalt. Steam or water can be sprayed (not shown) into the vapor space above the asphalt to suppress foaming and to dilute the oxygen content of waste gases that are removed via line 14 and conducted to knockout drum 5 to remove any condensed or entrained liquids via line 17. The oxidizer vessel 2 is typically operated at low pressures of 0 to 2 barg. The temperature of the oxidizer vessel can be from 150° C. to 300° C., preferably from 200° C. to 270° C., and more preferably from 250° C. to 270° C. It is preferred that the temperature within the oxidizer will be at least 10° C. higher, preferably 20° C., and more preferably 30° C. higher than the incoming asphalt feed temperature. The low pressure off-gas, which is primarily comprised of nitrogen and water vapor, is often conducted via line 16 to an incinerator 8 where it is burned before being discharged to the atmosphere. The oxidized asphalt product stream is then conducted via line 18 and pumped via pump 6 through heat exchanger 1 wherein it is used to preheat the asphalt feed being conducted to oxidizer vessel 2. The hot asphalt product stream is then conducted via line 20 to steam generator 7 where it is cooled prior to going to storage.

In an alternative configuration, a liquid jet ejector technology can be used to improve the performance of an air blowing process. The liquid jet ejector technology eliminates the need for an air compressor; improves the air/oil mixing compared to that of a conventional oxidizer vessel, thus reducing excess air requirements and reducing the size of the off-gas piping; reduces the excess oxygen in the off-gas allowing it to go to the fuel gas system, thus eliminating the need for an incinerator; and reduces the reaction time, thus reducing the size requirement of the oxidizer vessel.

Liquid jet ejectors are comprised of the following components: a body having an inlet for introducing the motive liquid, a converging nozzle that converts the motive liquid into a high velocity jet stream, a port (suction inlet) on the body for the entraining in of a second liquid or gas, a diffuser (or venturi), and an outlet wherein the mixed liquid stream is discharged.

In a liquid jet ejector, a motive liquid under high pressure flows through converging nozzles into the mixing chamber and at some distance behind the nozzles forms high-velocity and high-dispersed liquid jets, which mix with entrained gas, speeding up the gas and producing a supersonic liquid-gas flow inside the mixing chamber. Kinetic energy of the liquid jet is transferred to the entrained gas in the mixing chamber producing vacuum at the suction inlet. Hypersonic liquid-gas flow enters the throat, where it is decelerated by the compression shocks. Thus, the low pressure zone in the mixing chamber is isolated from the high pressure zones located downstream.

Figure 2:
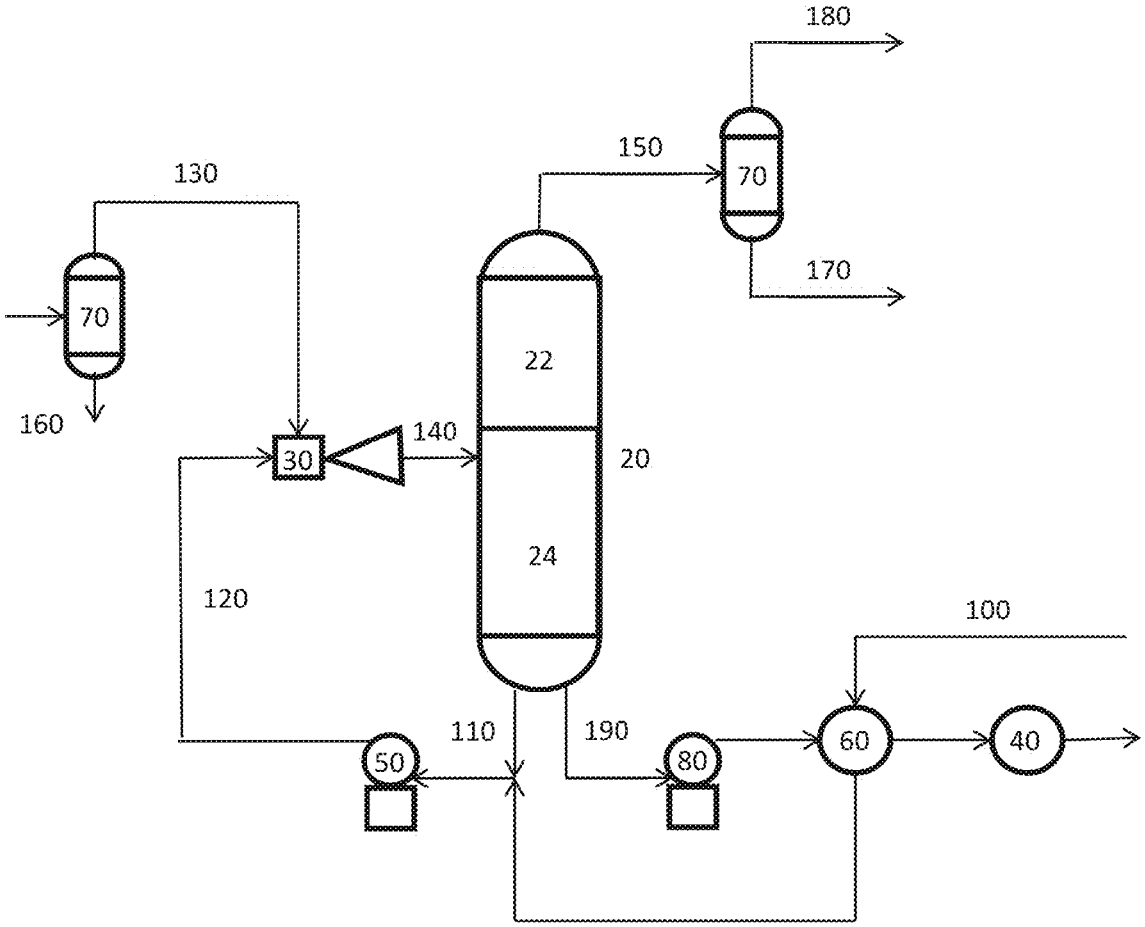
FIG. 2 hereof is a process flow scheme of an asphalt oxidation process.

FIG. 2 hereof is a process flow scheme of a process for oxidizing asphalts using liquid jet ejectors. An asphalt feed via line 100 is preheated in heat exchanger 60 and combined with a portion of the oxidized asphalt product from oxidizer vessel 20 via line 110 and pumped via pump 50 via line 120 to the liquid jet ejector 30 motive inlet and mixed with an effective amount of air via line 130 to liquid jet ejector 30 suction inlet via knockout drum 70. Any liquid collected from knockout drum 70 is drained via line 170. The amount of oxidized asphalt product recycled from the oxidizer will be at least 5 times, preferably at least 10 times, and more preferably at least 20 times that of the volume of incoming asphalt feed. By effective amount of air we mean at least a stoichiometric amount, but not so much that it will cause undesirable results from either a reaction or a process point of view. The stoichiometric amount of air will be determined by the amount of oxidizable components in the particular asphalt feed. It is preferred that a stoichiometric amount of air be used.

Any suitable liquid jet ejector can be used as part of an air blowing oxidation process. Liquid jet ejectors are typically comprised of a motive inlet, a motive nozzle, a suction port, a main body, a venturi throat and diffuser, and a discharge connection, wherein the hot asphalt, at a temperature from 125° C. to 300° C., is conducted as the motive liquid into said motive inlet and wherein air is drawn into the suction port and mixed with the asphalt within the ejector body. The air drawn into the suction port of the liquid jet ejector may be either atmospheric air or compressed air. The pressurized air/asphalt mixture is then conducted via line 140 to oxidizer/separation vessel 20. The pressure of the mixture exiting the liquid jet ejector will be in excess of the pressure at which the oxidizer is operated and will be further adjusted to allow for the resulting off gas from the oxidizer to be introduced into the fuel gas system of the refinery. The oxidizer vessel 20 is operated at pressures from 0 to 10+ barg, preferably from 0 to 5 barg and more preferably from 0 to 2 barg. The temperature of the oxidizer vessel can be from 150° C. to 300° C., preferably from 200° C. to 270° C., and more preferably from 250° C. to 270° C. It is preferred that the temperature within the oxidizer will be at least 10° C. higher, preferably 20° C., and more preferably 30° C. higher than the incoming asphalt feed temperature. Off-gas is collected overhead via line 150 and passed through a knockout drum 70 where liquids are drained off via line 170 for further processing and the vapor because of its pressure and low oxygen content can be routed into the refinery fuel gas system via line 180. The oxidized product is conducted via line 190 through pump 80, heat exchanger 60 and steam generator 40. An effective amount of steam can be conducted (not shown) to the vapor space 22 above or below the asphalt level 24 in the oxidizer 20 to dilute the oxygen content of the off-gas, primarily for safety purposes. By effective amount of steam is meant at least that amount needed to dilute the oxygen content of the resulting off gas to a predetermined value. The oxidized product stream is then routed to product storage via line 190 while a portion of it is recycled via line 110 to line 120 where it is mixed with fresh feed, which functions to provide the necessary motive fluid for the liquid jet ejector.

Product Properties from Air Blowing of PFT Crudes

One way of characterizing an asphalt composition is by using SUPERPAVE™ criteria. SUPERPAVE™ criteria (as described in the June 1996 edition of the AASHTO Provisional Standards Book and 2003 revised version) can be used to define the Maximum and Minimum Pavement service temperature conditions under which the binder must perform. SUPERPAVE™ is a trademark of the Strategic Highway Research Program (SHRP) and is the term used for new binder specifications as per AASHTO MP-1 standard. Maximum Pavement Temperature (or "application" or "service" temperature) is the temperature at which the asphalt binder will resist rutting (also called Rutting Temperature). Minimum Pavement Temperature is the temperature at which the binder will resist cracking. Low temperature properties of asphalt binders were measured by Bending Beam Rheometer (BBR). According to SUPERPAVE™ criteria, the temperature at which a maximum creep stiffness (S) of 300 MPa at 60 s loading time is reached, is the Limiting Stiffness Temperature (LST). Minimum Pavement Temperature at which the binder will resist cracking (also called Cracking Temperature) is equal to LST-10° C.

The SUPERPAVE™ binder specifications for asphalt paving binder performance establishes the high temperature and low temperature stiffness properties of an asphalt. The nomenclature is PG XX-YY which stands for Performance Grade at high temperatures (HT), XX, and at low temperatures (LT), −YY degrees C., wherein −YY means a temperature of minus YY degrees C. Asphalt must resist high summer temperature deformation at temperatures of XX degrees C. and low winter temperature cracking at temperatures of −YY degrees C. An example popular grade in Canada is PG 58-28. Each grade of higher or lower temperature differs by 6° C. in both HT and LT. This was established because the stiffness of asphalt doubles every 6° C. One can plot the performance of asphalt on a SUPERPAVE™ matrix grid. The vertical axis represents increasing high PG temperature stiffness and the horizontal axis represents decreasing low temperature stiffness towards the left. In some embodiments, a heavy oil fraction used for producing the deasphalted residue and/or the heavy oil fraction used for forming a mixture with the deasphalted residue can have a performance grade at high temperature of 58° C. or less, or 52° C. or less, or 46° C. or less.

Figure 3:
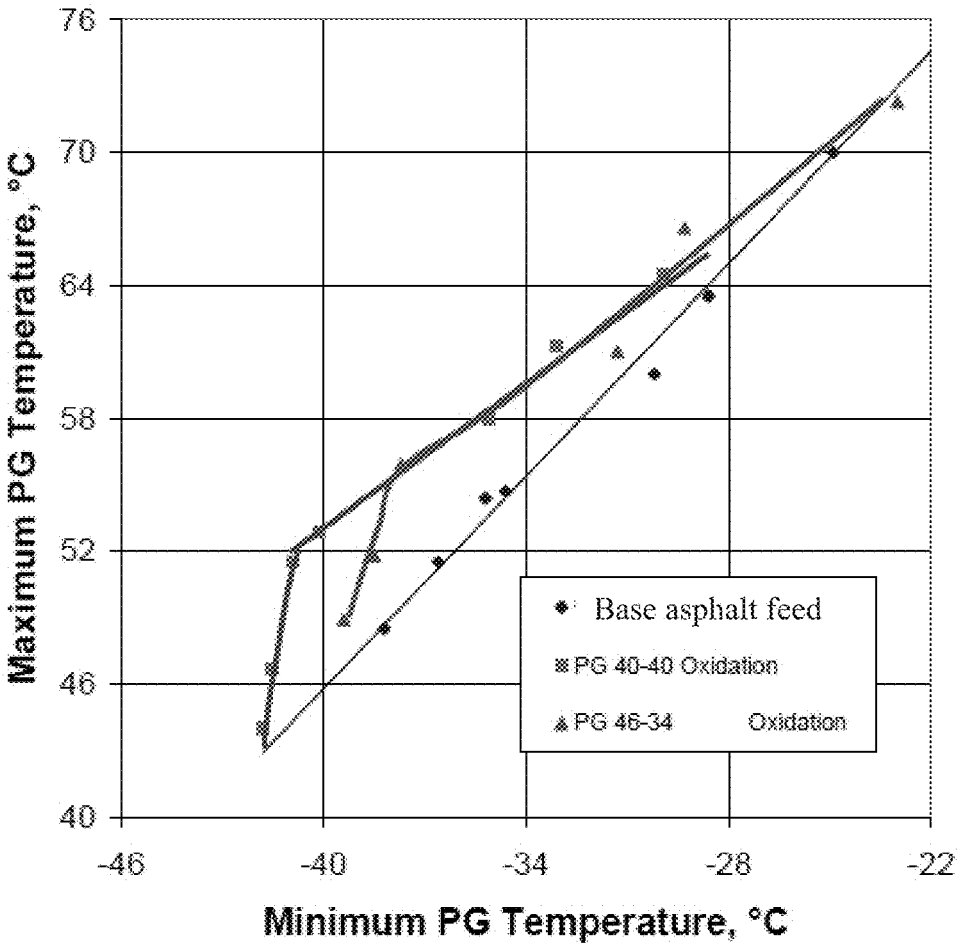
FIGS. 3-5 show asphalt grades that can be formed from asphalt feeds and corresponding oxidized asphalt feeds.

The data in FIG. 3 is plotted on a SUPERPAVE™ PG matrix grid. These curves pass through various PG specification boxes. Asphalt binders from a particular crude pass the SUPERPAVE™ specification criteria if they fall within the PG box through which the curves pass. Directionally poorer asphalt performance is to the lower right. Target exceptional asphalt or enhanced, modified asphalt performance is to the upper left, most preferably in both the HT and LT performance directions.

Although asphalt falls within a PG box that allows it to be considered as meeting a given PG grade, the asphalt may not be robust enough in terms of statistical quality control to guarantee the PG quality due to variation in the PG tests. This type of property variation is recognized by the asphalt industry as being as high at approximately +/−3° C. Thus, if an asphalt producer wants to consistently manufacture a given grade of asphalt, such PG 64-28, the asphalt producer must ensure that the PG tests well within the box and not in the right lower corner of the box. Any treatment which moves the curve out of the lower right corner even if only in the HT direction is deemed to result in the production of a higher quality asphalt, even if nominally in the same grade.

EXAMPLES

In the examples below, oxidized feeds were oxidized at 260° C. with an air flow rate of 50 L/hr/kg at atmospheric pressure in a batch process. Typical oxidizer loadings were 3 kg of asphalt. Samples were taken from the oxidizer at various intervals, but the air flow was maintained at a constant rate of 50 L/hr/kg. The oxidized samples were graded according to SUPERPAVE™ PG grading specifications.

FIG. 3 shows an example of the effect of oxidation by air blowing for a typical asphalt. FIG. 3 shows several SUPERPAVE™ curves for a single asphalt feed. The data points corresponding to the diamond marks represent the base asphalt feed. Without further distillation, the asphalt feed will produce a PG 40-40 asphalt in the SUPERPAVE™ performance grades. This base asphalt feed has a penetration value at 25° C. (100 g/5 s) of 384 dmm and a viscosity at 100° C. of 879 cSt. The asphaltene content (n-heptane insolubles) of the base asphalt feed is 13 wt %. Distilling the asphalt feed allows the other asphalts along the curve fit line to be made.

The data points corresponding to squares in FIG. 3 represent asphalts that can be made by using air blowing to oxidize the base PG 40-40 asphalt feed. As shown in FIG. 3, oxidation of the feed initially results in a benefit for the maximum PG temperature with little impact on the low temperature properties. However, only 6-10° C. of high temperature increase are achieved in this region. After the initial 6-10 degree increase in the maximum PG temperature, further oxidation results in both an increase in the maximum temperature and an increase in the minimum temperature for the resulting asphalt. The slope of the line corresponding to additional oxidation of the base asphalt feed corresponds to less than or equal to 4 degrees of gain in the maximum PG temperature for every 3 degrees of gain in the minimum PG temperature.

The data points corresponding to the squares in FIG. 3 represent performing oxidation on a distilled asphalt feed so that the starting feed for oxidation is a PG 46-34 feed instead of a PG 40-40 feed. As shown in FIG. 3, starting with a distilled feed has a limited impact on the oxidation process. The initial increase in maximum temperature is sufficient to approximately join the oxidation curve for the base asphalt feed. Further oxidation of the distilled feed also results in the increase of both the maximum and minimum temperatures along roughly the same line as the base asphalt feed.

Figure 4:
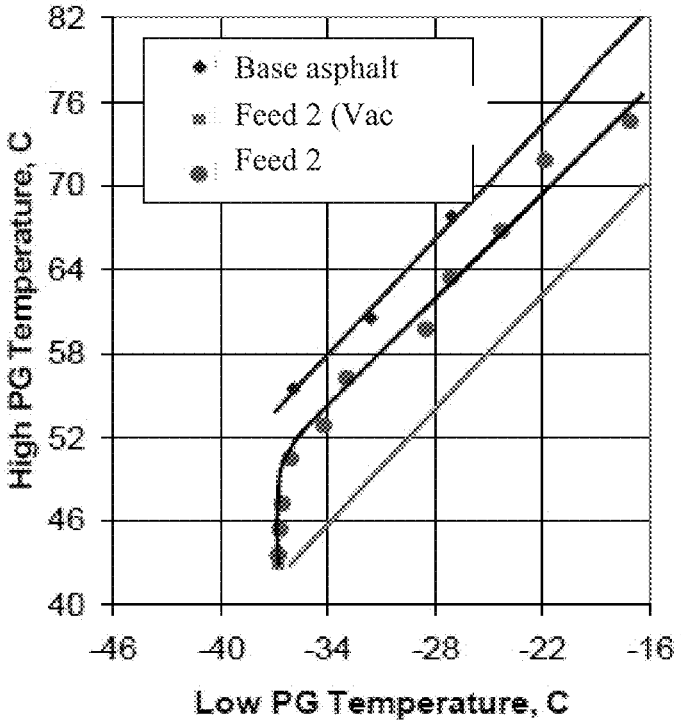

The behavior shown for the base asphalt feed in FIG. 3 can also be found in asphalts derived from other typical crudes. FIG. 4 shows SUPERPAVE™ curves for asphalt feeds derived from another crude source. In FIG. 4, the base asphalt feed shown in FIG. 3 is once again represented by the diamond data points. A second asphalt feed is shown by the square data points, and corresponds to the curve that is farthest to the right in FIG. 4. The second asphalt feed is a vacuum resid feed generated based on a maximum cut point of 568° C. The PG grade of this vacuum resid feed without further distillation is PG 40-34. This vacuum resid feed has a penetration value at 25° C. (100 g/5 s) of 500 dmm and a viscosity at 100° C. of 543 cSt. The asphaltene content (n-heptane insolubles) is 3 wt %. Thus, this vacuum resid feed has a low starting amount of asphaltenes. However, the vacuum resid feed in FIG. 4 is not an asphaltene-depleted crude, as the asphaltenes are not reduced or depleted in any substantial manner relative to an amount present in the corresponding raw crude. In FIG. 4, only the initial vacuum resid feed data point is provided, with a line indicating the additional asphalts available by distilling the vacuum resid.

The circle data points correspond to asphalts that can be made by oxidizing the vacuum resid feed. The oxidation behavior for the vacuum resid feed in FIG. 4 is similar to the behavior for the asphalt feed shown in FIG. 3. After a brief improvement of 6-10 degrees in maximum temperature, the maximum temperature and the minimum temperature both increase with further oxidation. The slope of the line showing the increase in both maximum and minimum PG temperatures in FIG. 4 is also less than or equal to 4° C. maximum PG temperature increase for every 3° C. of minimum PG temperature increase.

Figure 5:
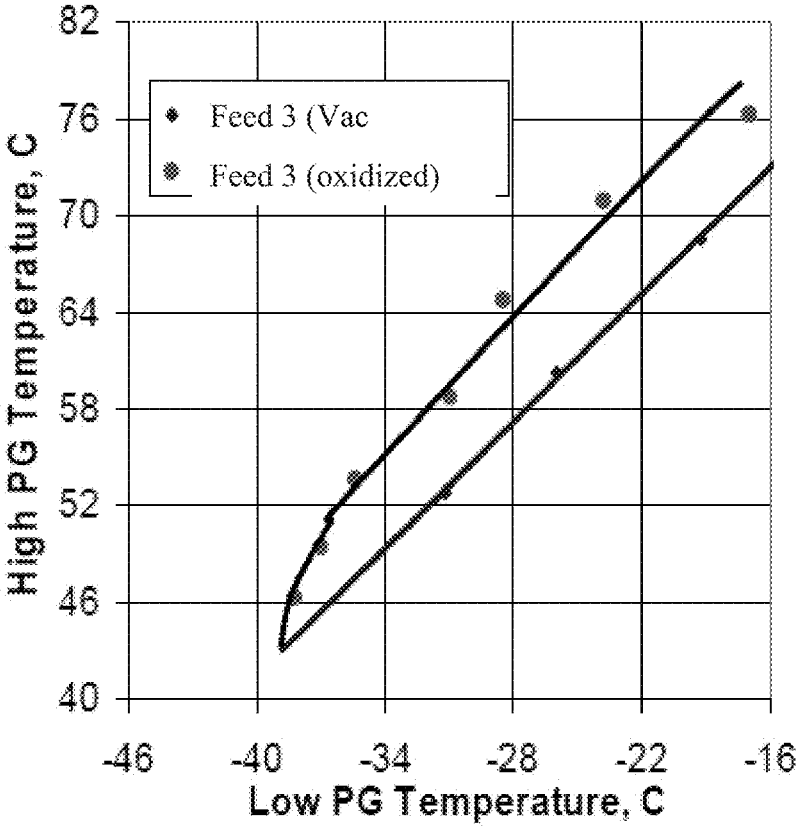

FIG. 5 shows SUPERPAVE™ curves for asphalt feeds derived from yet another crude source. The asphalt feed without further distillation in FIG. 5 is shown by the diamond data points. The asphalt feed in FIG. 5 is another vacuum resid feed generated based on a maximum cut point of 515° C. The PG grade of this vacuum resid feed without further distillation is PG 40-34. This vacuum resid feed has a penetration value at 25° C. (100 g/5 s) of 500 dmm and a viscosity at 100° C. of 465 cSt. The asphaltene content (n-heptane insolubles) is 11 wt %. Once again, oxidation of the asphalt feed in FIG. 5 results in an initial increase in maximum PG temperature of between 6-10° C. Beyond the initial increase, further oxidation of this feed results in a slightly more favorably trade-off of maximum PG temperature to minimum PG temperature, but the slope is still less than or equal to 4° C. maximum PG temperature increase for every 3° C. of minimum PG temperature increase.

Based on FIGS. 3-5, oxidation of typical asphalt feeds provides limited benefits, due to the degradation of the minimum PG temperature for the oxidized feeds with additional oxidation. Oxidation can produce an initial 6-10° C. of increase in the maximum PG temperature with only a minimal increase in the minimum PG temperature. Further oxidation results in a slope of less than or equal to 4° C. of maximum PG temperature increase for every 3° C. of minimum PG temperature increase. The net result is that, for a conventional asphalt feed, increasing the maximum PG temperature by 15° C. or more requires a corresponding increase in the minimum PG temperature of at least 6° C. This limits the usefulness of oxidation for upgrading of typical asphalt feeds.

Figure 6:
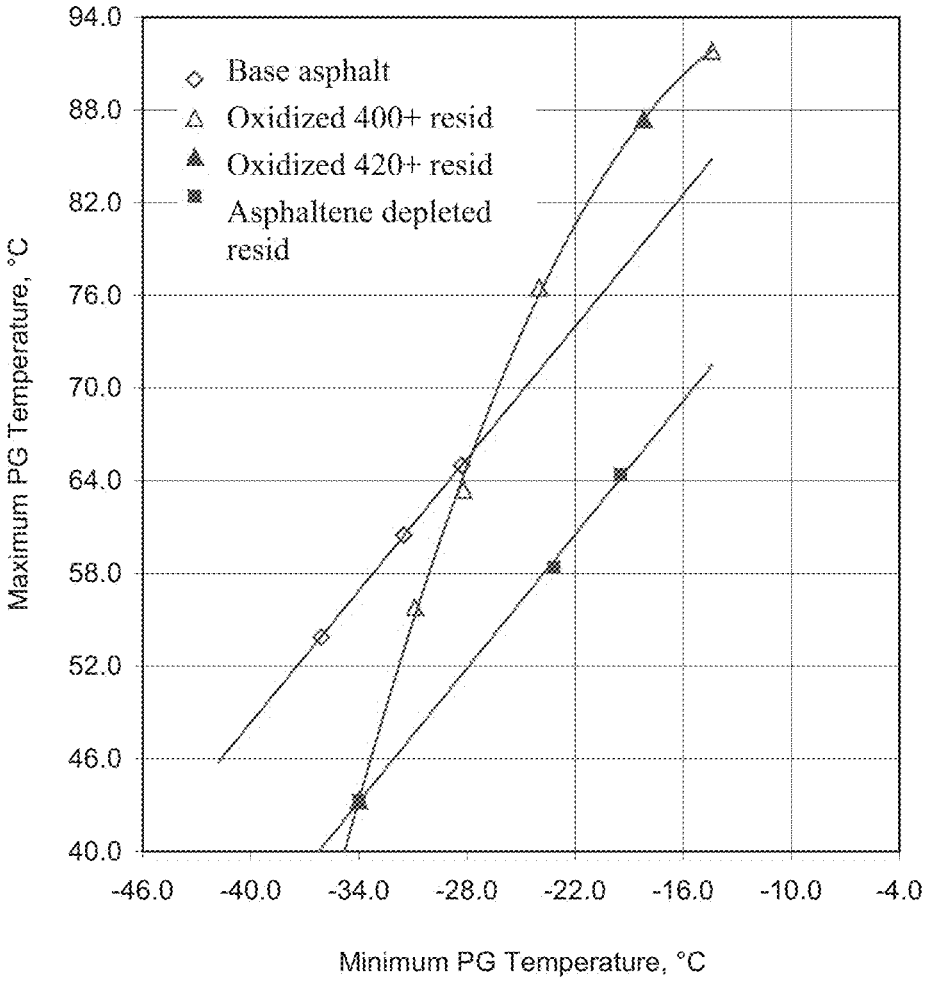
FIG. 6 shows asphalt grades that can be formed from an asphaltene-depleted feed and corresponding oxidized asphaltene-depleted feeds.

FIG. 6 shows the oxidation behavior for an asphaltene-depleted feed. The filled squares correspond to the asphaltene-depleted feed, which is a 420° C.+ resid from a crude that was extracted and processed using a paraffinic froth treatment process prior to transport to a refinery. The asphaltene content was 5 wt % based on n-heptane insolubles. The amount of pentane insoluble asphaltenes was 8 wt %. During the paraffinic froth treatment, 50 wt % of the pentane insoluble asphaltenes were rejected. The PG grade of this asphaltene-depleted resid feed without further distillation is PG 40-28. This vacuum resid feed has a penetration value at 25° C. (100 g/5 s) of 490 dmm and a viscosity at 100° C. of 610 cSt. For comparison, the base asphalt feed from FIG. 3 is shown using the open diamond symbols.

Without oxidation, the 420° C.+ resid from the asphaltene-depleted feed is not suitable for making typical North American asphalt grades, as the distillation curve on the SUPERPAVE™ matrix does not pass through the 58-28 box. However, the asphaltene-depleted feed can be oxidized to a much greater degree with only modest impact on the minimum PG temperature. The open triangles show the properties of the asphaltene-depleted feed after various amounts of oxidation. The oxidation was repeated using another sample of the asphaltene-depleted feed that was cut at 400° C. The repeat oxidation run is shown by the filled triangles. FIG. 6 shows that the oxidation profile is similar for both the 400° C.+ and the 420° C.+ resids. As shown in FIG. 6, substantial increases in the maximum PG temperature are achieved with only a modest increase in the minimum PG temperature. As noted above, the oxidation curve for typical crudes will have a slope similar to 4 degrees of maximum PG temperature increase for every 3 degrees of increase in the minimum temperature. By contrast, oxidation of the asphaltene-depleted resid produces a slope of more than 2 degrees of maximum PG temperature increase for each degree of increase in the minimum PG temperature. This larger slope allows the asphaltene-depleted feed to be upgraded to a much larger degree via oxidation. FIG. 6 shows that oxidation of an asphaltene-depleted feed can be used to achieve an increase in the maximum PG temperature of at least 15° C., such as at least 18° C., while producing an increase in the minimum PG temperature of 6° C. or less. Alternatively, this can be expressed as an increase in maximum PG temperature of at least 15° C., such as at least 18° C., with a ratio of increase in maximum PG temperature to minimum PG temperature of at least 5 to 2.

More generally, the response of asphaltene-depleted crudes to oxidation can be used to modify the oxidation behavior of an asphalt feed for both asphalt feeds entirely composed of asphaltene-depleted crudes as well as asphalt feeds derived from a blend of crude fractions. A first portion of an oxidation process under effective oxidation conditions can be used to increase the maximum PG temperature by up to 10° C. with only a minimal increase in the minimum PG temperature. At this point, a typical crude gains limited benefit from further oxidation, as additional increase in the maximum PG temperature results in a corresponding increase in the minimum PG temperature in a ratio of 4 to 3 or less. By contrast, a feed including at least a portion of material derived from an asphaltene-depleted crude can be further oxidized (i.e., in addition to the initial 10° C. of increase in maximum PG temperature) with a ratio of maximum PG temperature increase to minimum PG temperature increase of greater than 4 to 3, such as at least 5 to 3 or at least 2 to 1.

Without being bound by any particular theory, it is believed that the unexpected benefits achieved by air blowing of asphaltene-depleted crudes or crude fractions are based on the enhanced ability of an asphaltene-depleted crude to solvate additional asphaltenes made during oxidation. The asphalt feed portion of a crude (such as a vacuum resid portion) typically contains at least four types of molecules. The asphalt feed portion will typically include saturated molecules (such as paraffins and other molecules without double bonds or aromatic groups); naphthene aromatics; polar aromatics; and asphaltenes.

During a typical oxidation process, such as air blowing, the naphthene aromatics and polar aromatics are converted to additional asphaltenes. However, the naphthene aromatics and polar aromatics are also important for solvating asphaltenes present in a crude fraction. Thus, oxidation of a crude fraction creates more asphaltenes while reducing the ability of the crude fraction to solvate the asphaltenes.

An asphaltene-depleted crude fraction corresponds to a crude fraction that previously contained a greater level of asphaltenes. The corresponding ability to provide solvation for that greater amount of asphaltenes is also believed to be present in an asphaltene-depleted crude fraction. As a result, when an asphaltene-depleted crude fraction is oxidized, the initial conversion of polar and naphthenic aromatics to asphaltenes does not create difficulties in solvating the newly formed asphaltenes. It is believed that this additional ability of an asphaltene-depleted crude to solvate new asphaltenes contributes to the improved performance of asphaltene-depleted crudes when oxidized.

PCT AND EP CLAUSES

1. A method for upgrading an asphalt feed, comprising: receiving an asphalt feed comprising an asphaltene-depleted crude fraction, the asphaltene-depleted crude fraction including at least 20 wt % less asphaltenes than the corresponding raw crude; and oxidizing the asphalt feed by air blowing under effective conditions to achieve an increase of a maximum PG temperature in the corresponding asphalt of at least 15° C., the minimum PG temperature increasing by 6° C. or less.

2. A method for upgrading an asphalt feed, comprising: receiving an asphalt feed comprising an asphaltene-depleted crude fraction, the asphaltene-depleted crude fraction including at least 20 wt % less asphaltenes than the corresponding raw crude; and oxidizing the asphalt feed by air blowing under effective conditions to achieve an increase of a maximum PG temperature in the corresponding asphalt of at least 15° C., the ratio of the increase of the maximum PG temperature to an increase in the corresponding minimum PG temperature being at least 5 to 2.

3. The method of clauses 1 or 2, wherein the asphalt is oxidized under effective conditions to achieve an increase of the maximum PG temperature in the corresponding asphalt of at least 18° C.

4. A method for upgrading an asphalt feed, comprising: receiving an asphalt feed comprising at least an asphaltene-depleted crude fraction, the asphaltene-depleted crude fraction including 20 wt % less asphaltenes than the corresponding raw crude; oxidizing the asphalt feed by air blowing under effective conditions to achieve an increase of a maximum PG temperature of 10° C., a corresponding minimum PG temperature increasing by a first amount; and oxidizing the asphalt feed by air blowing under effective conditions to achieve an additional increase of the maximum PG temperature in the corresponding asphalt of at least 5° C., a ratio of the additional increase of the maximum PG temperature to an additional increase of the corresponding minimum PG temperature being at least 5 to 3.

5. The method of clause 4, wherein the ratio of the additional increase of the maximum PG temperature to the additional increase of the corresponding minimum PG temperature is at least 2 to 1.

6. The method of any of the preceding clauses, wherein receiving an asphalt feed comprises: receiving a feedstock comprising one or more crude fractions, at least one crude fraction being the asphaltene-depleted crude fraction; and distilling the feedstock to form at least the asphalt feed.

7. The method of clause 6, wherein the asphalt feed comprises a bottom fraction from the distillation.

8. The method of clauses 6 or 7, wherein the feedstock comprising one or more crude fractions comprises at least 25 wt % of the asphaltene-depleted crude fraction.

9. The method of any of the preceding clauses, wherein the asphalt feed comprises at least 25 wt % of the asphaltene-depleted crude fraction, preferably at 35 wt % or at least 45 wt %.

10. The method of any of the preceding clauses, wherein the asphaltenes correspond to asphaltenes that are insoluble in n-pentane, n-heptane, or a $C_5$-$C_8$ alkane.

11. The method of any of the preceding clauses, wherein the asphaltene-depleted crude includes at least 25 wt % less asphaltenes than the corresponding raw crude, preferably at least 35 wt % less or at least 45 wt % less.

12. The method of any of the preceding clauses, wherein the asphaltene-depleted crude is formed by performing a paraffinic froth treatment on a raw crude or crude fraction.

13. The method of any of the preceding clauses, wherein the effective conditions include an asphalt feed temperature of 125° C. to 300° C., an oxidizing temperature of 150° C. to 300° C. and an oxidizing pressure of 0 barg to 10 barg.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for upgrading an asphalt feed, comprising:

receiving an asphalt feed comprising an asphaltene-depleted crude fraction, the asphaltene-depleted crude fraction including at least 20 wt % less asphaltenes than the corresponding raw crude, wherein the asphaltene-depleted crude is formed by performing a paraffinic froth treatment on a raw crude or crude fraction; and oxidizing the asphalt feed by air blowing under effective conditions to achieve an increase of a maximum PG temperature in the corresponding asphalt of at least 15° C., the minimum PG temperature increasing by 6° C. or less.

2. The method of claim 1, wherein the asphalt is oxidized under effective conditions to achieve an increase of the maximum PG temperature in the corresponding asphalt of at least 18° C.

3. The method of claim 1, wherein receiving an asphalt feed comprises:

receiving a feedstock comprising one or more crude fractions, wherein at least one of the one or more crude fractions is the asphaltene-depleted crude fraction; and distilling the feedstock to form at least the asphalt feed.

4. The method of claim 3, wherein the asphalt feed comprises a bottom fraction from the distillation.

5. The method of claim 3, wherein the feedstock comprises at least 25 wt % of the asphaltene-depleted crude fraction.

6. The method of claim 1, wherein the asphalt feed comprises at least 25 wt % of the asphaltene-depleted crude fraction.

7. The method of claim 1, wherein the asphaltenes correspond to asphaltenes that are insoluble in n-pentane, n-heptane, or a $C_5$-$C_8$ alkane.

8. The method of claim 1, wherein the asphaltene-depleted crude includes at least 45 wt % less asphaltenes than the corresponding raw crude.

9. The method of any of the above claims, wherein the effective conditions include an asphalt feed temperature of 125° C. to 300° C., an oxidizing temperature of 150° C. to 300° C., and an oxidizing pressure of 0 barg to 10barg.

10. A method for upgrading an asphalt feed, comprising:

receiving an asphalt feed comprising at least an asphaltene-depleted crude fraction, the asphaltene-depleted crude fraction including 20 wt % less asphaltenes than the corresponding raw crude, wherein the asphaltene-depleted crude is formed by performing a paraffinic froth treatment on a raw crude or crude fraction;

oxidizing the asphalt feed by air blowing under effective conditions to achieve an increase of a maximum PG temperature of 10° C., a corresponding minimum PG temperature increasing by a first amount to form an oxidized asphalt feed; and further oxidizing the oxidized asphalt feed by air blowing under effective conditions to achieve an additional increase of the maximum PG temperature in the corresponding asphalt of at least 5° C., a ratio of the additional increase of the maximum PG temperature to an additional increase of the corresponding minimum PG temperature being at least 5 to 3.

11. The method of claim 10, wherein the ratio of the additional increase of the maximum PG temperature to the additional increase of the corresponding minimum PG temperature is at least 2 to 1.

12. The method of claim 10, wherein receiving an asphalt feed comprises:

receiving a feedstock comprising one or more crude fractions, wherein at least one of the one or more crude fractions is the asphaltene-depleted crude fraction; and distilling the feedstock to form at least the asphalt feed.

13. The method of claim 12, wherein the asphalt feed comprises a bottom fraction from the distillation.

14. The method of claim 12, wherein the feedstock comprises at least 25 wt % of the asphaltene-depleted crude fraction.

15. The method of claim 10, wherein the asphaltenes correspond to asphaltenes that are insoluble in n-pentane, n-heptane, or a $C_5$-$C_8$ alkane.

16. The method of claim 10, wherein the asphaltene-depleted crude includes at least 45 wt % less asphaltenes than the corresponding raw crude.

17. A method for upgrading an asphalt feed, comprising:

receiving an asphalt feed comprising an asphaltene-depleted crude fraction, the asphaltene-depleted crude fraction including at least 20 wt % less asphaltenes than the corresponding raw crude, wherein the asphaltene-depleted crude is formed by performing a paraffinic froth treatment on a raw crude or crude fraction; and oxidizing the asphalt feed by air blowing under effective conditions to achieve an increase of a maximum PG temperature in the corresponding asphalt of at least 15° C., the ratio of the increase of the maximum PG temperature to an increase in the corresponding minimum PG temperature being at least 5 to 2.

18. The method of claim 17, wherein the asphalt is oxidized under effective conditions to achieve an increase of the maximum PG temperature in the corresponding asphalt of at least 18° C.

* * * * *